US005820702A

United States Patent [19]

Irie et al.

[11] Patent Number: 5,820,702

[45] Date of Patent: Oct. 13, 1998

[54] WELDED NOSE RAIL USED FOR CROSSING

[75] Inventors: Takaaki Irie, Himeji; Hisashi Takahata, Ibo-gun, both of Japan

[73] Assignee: Yamato Kogyo Co., Ltd., Hyogo, Japan

[21] Appl. No.: 741,204

[22] Filed: Oct. 29, 1996

Related U.S. Application Data

[62] Division of Ser. No. 167,094, Dec. 16, 1993, Pat. No. 5,704,570.

[30] Foreign Application Priority Data

Dec. 16, 1992 [JP] Japan ..... 4-355270
Feb. 1, 1993 [JP] Japan ..... 5-37526

[51] Int. Cl.[6] ..... C21D 9/04

[52] U.S. Cl. ..... 148/529; 148/581

[58] Field of Search ..... 148/529, 581, 148/585

[56] References Cited

U.S. PATENT DOCUMENTS 1,774,263 8/1930 Gillispie .
1,788,622 1/1931 Gillispie .
1,794,287 2/1931 Germann .
2,174,367 9/1939 Hoffman .
4,575,397 3/1986 Heller .

FOREIGN PATENT DOCUMENTS 1049890 2/1959 Germany .
63-65735 12/1988 Japan .
1-197093 8/1989 Japan .

*Primary Examiner*—Deborah Yee

[57] ABSTRACT

A nose type rail member for crossing member applied to a turnout or wayside switch system on the ground for a train and the like, is made of high carbon steel material containing 0.70 to 0.82 wt. % of carbon. The rail member is constructed by a pair of rail parts, which has a concave at a side of the middle support part. A backing plate is made of the same as the rail member or a steel material having a less carbon content than that of the rail member and is holden by a pair of the opposite concaves. A pair of the head portions and the base portions at a side thereof are joined by means of electron beam welding and the joined rail member is subjected to S.Q. heat processing, thereby at least a wheel tread of the rail member becomes a homogeneous and fine pearlite structure.

20 Claims, 17 Drawing Sheets

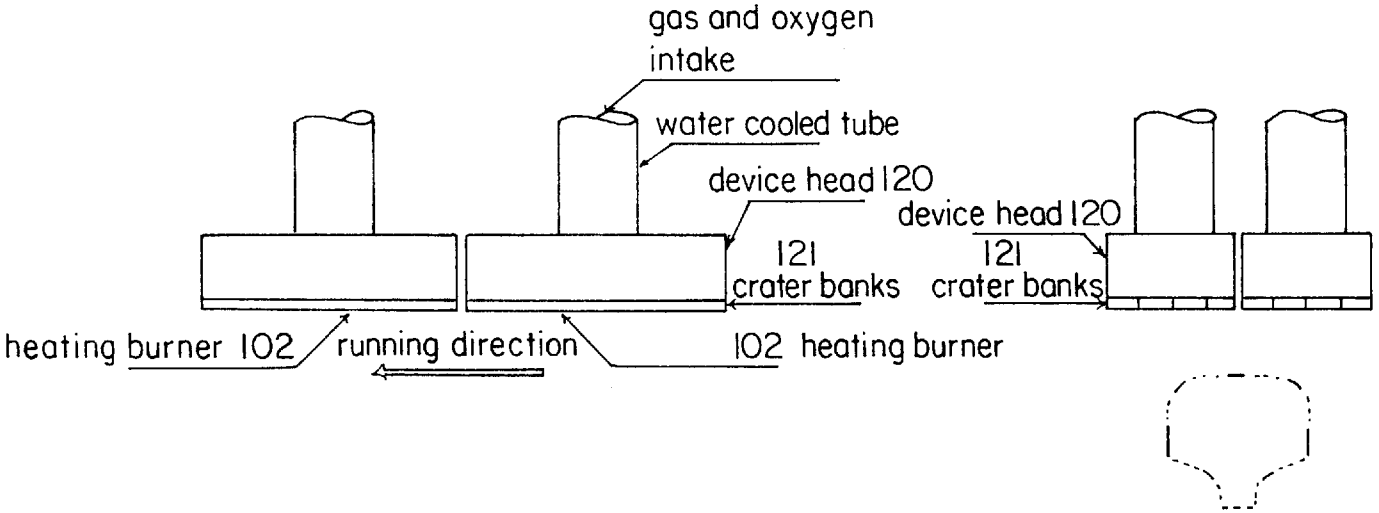
FIG. 25A
FIG. 25B
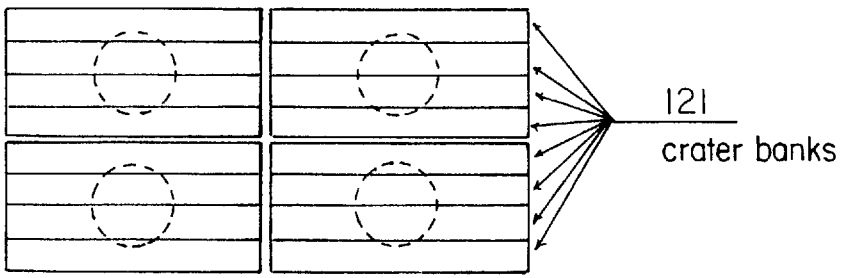
FIG. 25C

WELDED NOSE RAIL USED FOR CROSSING

This application is a divisional of application Ser. No. 08/167,094, filed on Dec. 16, 1993, the entire contents of which are hereby incorporated by reference, now U.S. Pat. No. 5,704,570.

SPECIFICATION

1. Field of Invention

This invention relates to a nose type rail member used for crossing at a rail turnout, a method for manufacturing the same and a welded crossing using said nose rail.

2. Description of Related Art

The crossing for a railway turnout is a wayside switch system of rolling stock track on the ground, which comprises a nose rail in which the head branching into two and the integrated head run in a line in the longitudinal direction and a wing rail on the side thereof. Traditionally, solid manganese steel crossing with high manganese cast iron and welded crossing with carbon steel are used. The former one has the advantage of being abrasion resistant, tough and durable. However, it is difficult to weld the front and back ends in the longitudinal direction joined with the wayside rail and it is necesary to join them with fish plates, resulting in the fault of causing joint missing line. On the other hand, the latter crossing has the advantage of having no joint missing line because the front and back ends can be welded. However, in the case of consumable electrode welding (shielded arc welding, MAG welding and the like), since medium carbon steel, which contains a limited amount of carbon (C:0.33–0.38%), is usually used in view of the welding property, Cr, Mo, B and the like are added, resulting in the disadvantage that abrasion and settling occur around the transferring point more easily than high carbon steel treated with heat and high manganese steel. And since it is difficult to weld the parts having a narrow head width in the front parts of the nose rail, the material formed and processed by rolling or casting rail having a thick stem and a specific cross section must be used, resulting in the disadvantage of high production cost.

Anyway, at present, it is desired to enhance the rate of the train and reduce the noise, therefore, there is a need not only to eliminate joint missing line as thoroughly as possible in the turnout, but also to enhance abrasion resistance and durability of the members used. Traditional solid manganese steel crossings and welded crossings have not been satisfactory.

As a crossing which can solve the above-mentioned problem, the welded crossing is known which is disclosed in Japanese Patent Unexamined Publication No. 1-197093. However, also in this welded crossing, wire used for the head of the nose rail is very expensive and the chemical composition of the high carbon steel varies with use such as NHH rail, DHH340 rail and DHH370 rail, and therefore, uneconomically, different wire must be used for every chemical composition of the kind of rail in order that deposited metal part should have the same SQ process ability as the base metal rail, there remaining further room for improvement.

And in the case of TIG welding using filler wire as added hot charge, U-shaped narrow beveling in the order of 8–10 mm is required. Moreover, because of multilayer welding, in spite of the low heat input, the welding distortion is large and a restricting means is complicated, resulting in a lot of trouble and high costs, there also remaining room for improvement.

OBJECTS OF THE INVENTION

In view of above-mentioned traditional technical subject, it is an object of the present invention to provide a welded nose rail for crossing which has the advantage of having no joint missing line with the front and back ordinary rail, which is the advantage of the welded crossing, and can enhance abrasion resistance and durability, which are the disadvantage thereof.

It is an another object of the present invention to provide a welded nose rail for crossing with which welding and beveling is easy and which requires no wire and can eliminate distortion by heat effect and a process of producing the same.

SUMMARY OF THE INVENTION

The present invention provides a nose rail for crossing used at a railway turnout on the ground in which a pair of rail members are joined at their side faces and the head branching into two and the integrated head run in a line, characterized in that said pair of rail members consist of high carbon steel containing 0.70 to 0.82% by weight of carbon and have facing cavities, which form a hollow holding backing material, at the stem point of the joint side face;

said backing material is the same steel as or steel containing a lower amount of carbon than said high carbon steel and held in the hollow so as to contact the hollow side end of the vertical joint of said head and base parts;

said integrated head part of said pair of rail members and the corresponding base part are directly joined with each other at least by electron beam welding;

the tread of the nose rail has a homogeneous fine pearlite structure.

Said pair of rails have a joint side face as a symmetry plane and are roughly divided into one group in which the rails are linearly symmetric with each other and the other group comprising a long nose rail and a short one.

And the present invention provides a method of producing the welded nose rail for crossing, which comprises:

joining head parts of a pair of rails with each other directly by electron beam welding, and heat processing the whole head part of said pair of rails by slack quenching. Said slack quenching type heat processing is preferably conducted after electron beam welding, but may be conducted before electron beam welding.

The first process of the present invention is to produce a nose rail for crossing used at a railway turnout on the ground in which a pair of rail members are joined at their side faces and the head branching into two and the integrated head run in a line, characterized in that said pair of rail members consist of high carbon steel containing 0.70 to 0.82% by weight of carbon and have facing cavities, which form a hollow holding backing material, at the stem point of the joining side face;

the head parts to be integrated of said pair of rail members are welded to the corresponding base parts by electron beam welding; and then the rail is treated by slack quenching type heat processing, resulting in a high carbon steel rail with at least the tread of the nose rail having an almost homogeneous fine pearlite structure.

And the second process of the present invention is to produce a nose rail for crossing used at a railway turnout on the ground in which a pair of rail members are joined at their side faces and the head branching into two and the integrated head run in a line, characterized in that said pair of rail members consist of high carbon steel containing 0.70 to 0.82% by weight of carbon and have facing cavities, which form a hollow holding backing material, at the stem point of the joining side face;

the rail is treated by slack quenching type heat processing, resulting in a high carbon steel rail member having a homogeneous pearlite structure; and then the head parts to be integrated of said pair of rail members are welded to the corresponding base parts by electron beam welding.

As a method which conducts S.Q heat processing continuously, a method (see Japanese Patent Publication No. 63-65735) can be used in which the head part of the rail is heated evenly with a heating device comprising a top face heating burner, of which the width of the flame can be adjusted depending on the width of the head of the rail, and a side face heating burner, which can move back and forth depending on the width of the head part of the rail, while said head part of the rail is cooled at a prescribed rate with a cooling device comprising a top face cooler, of which the width of the injection band of the cooling air can be adjusted depending on the width of the head of the rail, and a side face cooler, which can move back and forth depending on the width of the head part of the rail and inject cooling air and water, therefore, the desired abrasion resistance and fatigue resistance being obtained. However, since this method does not adequately consider the structural property of the nose rail for crossing wherein the front head part is integrated by welding and the back head part branches into two, in the case of heat processing the back head part the rail branching into two by S.Q heat processing, a large processing device must be used and the width of the flame band and the cooling air injecting band must be equal to the whole width of the opening of the head part of the rail branching into two, therefore, the heating and cooling efficiency may be poor.

Then, according to the present invention, the continuous S.Q heat processing of the head of the nose rail for a crossing comprises heating and cooling the nose rail for the crossing having a structure in which the front is integrated by welding and the back has a head shape branching into two and said heating process preferably comprises: arranging a pair of laterally spaced heating burners, each of which consists of plural device heads, above the head part of the nose rail; moving said heating burners and the nose rail relatively; moving said pair of heating burners in the direction of the head width varying with the longitudinal center line of the nose rail and rotating them at the opening angle of the head; adjusting the flame band by igniting and extinguishing plural craters of each device head; and controlling the flame strength of each device head to the proceeding direction by adjusting the flow of gas.

And according to the present invention, the continuous S.Q heat processing of the head of the nose rail for crossing comprises heating and cooling continuously the nose rail for crossing having a structure in which the front is integrated by welding and the back has a head shape branching into two and said cooling process preferably comprises: arranging a pair of laterally spaced coolers, each of which consists of plural air tanks, over the top face and side face of the head part of the nose rail; moving said coolers and the nose rail relatively; moving said pair of coolers in the direction of the head width varying with the longitudinal center line of the nose rail and rotating them at the opening angle of the head; controlling the cooling ability of the air shower with the compressed air within each air tank to the proceeding direction by adjusting the flow of air.

Said head part of the nose rail has one front end with a sharp shape, the width of the head becoming larger towards the rear, then the head branching into two, the resulting two rails expanding to the back end, with the result that the cross section of the head changes. Therefore, S.Q heat processing may be conducted after half-processing the front head part of the nose rail, which is integrated by welding and to be heat processed, into the maximum volume of size and shape which can satisfy the heat processing quality of the product.

And the back part of the nose rail, which branches into two, may have the parts below the jaw of the head covered with protecting plates and the like in order that the only head part of the rail can be heated or cooled by flame of the burner and air shower respectively.

The head part of the nose rail from the top end half-processed to the back end branching into two is continuously heated to the desired temperature distribution. However, at least the welded head part having a large volume may preferably be preheated wholly to 300°–500° C. with an electric furnace and the like.

In cooling, the whole rail from the top end to the point branching into two and the head part of the rail behind the point branching into two may be cooled to below 300° C. with an air shower.

Moreover, the method of welding the nose rail, for example, EBW method or pressure welding method, may preferably be a method requiring no added hot charge, because the chemical composition of the weld metal are almost the same as the base metal, in comparison with the welding method requiring added hot charge.

According to the nose rail of the present invention, a welded crossing integrating said nose rail and the wing rail can be assembled by welding the base part of said nose rail to the base part of said wing rail, which is a high carbon steel rail comprising high carbon steel containing 0.70 to 0.82% by weight and having an even pearlite structure obtained by slack quenching type heat processing, and fastening bolt and nut through the filler.

According to the present invention, the chemical composition of the weld metal is almost the same as the base metal rail and the material of a pair of rails is high carbon steel containing 0.70~0.82% by weight of carbon, and therefore, the welded part may have a fine pearlite structure and some pearlite structure by welding under the conditions considering the appropriate preheating temperature and welding heat input, resulting in the tread of the rail with both of the whole head parts welded having a substantially homogeneous fine pearlite structure. Moreover, in the case that the rail material is not previously heat processed by slack quenching, if the head part of the nose rail welded by electron beam is heat processed by slack quenching, the tread of the nose rail may have a homogeneous fine pearlite structure.

And when electron beam welding is used, the shape of the bevel may be an I-shaped bevel which can be processed most easily and the weld penetration can be very deep, with the result that one-pass rapid joining is possible. Automatic welding can also be used. Moreover, since the heat input per unit of plate thickness as well as the total heat input is smaller than that according to other welding methods, the width of the weld metal and the part influenced by heat is narrow and the deformation caused by the welding distortion is very small.

And with the use of the backing material, the spike and cold shut, which are welding defects peculiar to electron beam welding, can be absorbed by said backing material, and therefore, the welded part of the base material may be sound.

BRIEF DESCRIPTION OF DRAWINGS

FIGS. 25A–C illustrate in side elevation (FIG. 25A), in vertical elevation (FIG. 25B) and in bottom (FIG. 25C) the heating burner used in said continuous slack quenching type heat processing of the head part.

DETAILED DESCRIPTION OF THE INVENTION

The present invention will be apparent from a reading of the following description in connection with the embodiment shown in the accompanying drawings.

EXAMPLE 1

Figure 1A:
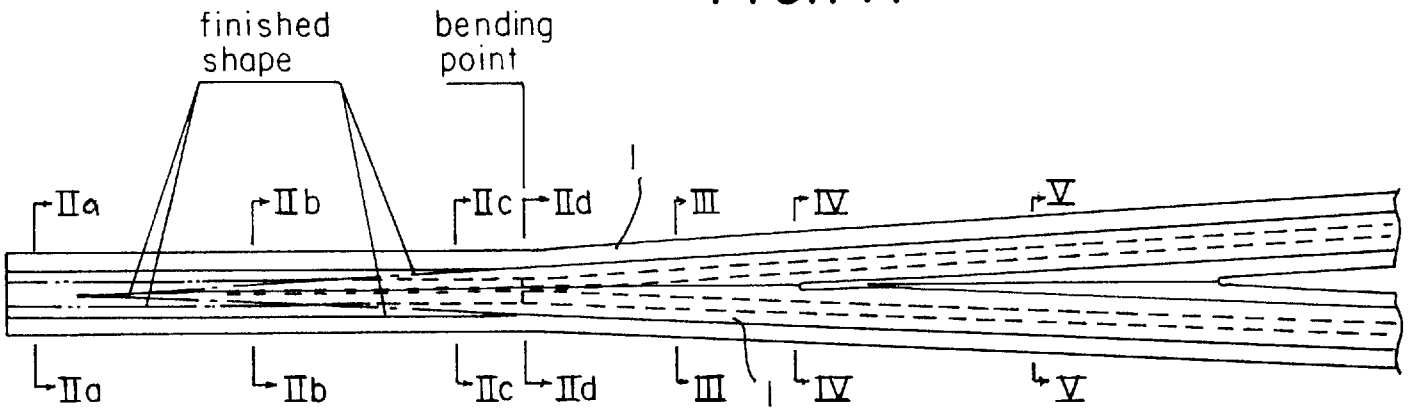
FIGS. 1A and 1B illustrate the whole planar structure of the welded nose rail for crossing of Example 1 produced according to the process of the present invention and the central section of said nose rail.
Figure 1B:
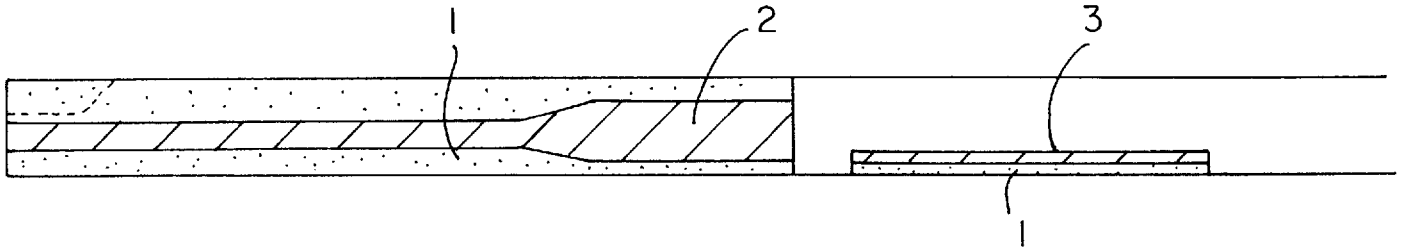

FIGS. 1A and 1B are plan views illustrating the whole welded nose rail for crossing of Example 1 produced according to the method of the present invention and a longitudinal central section view of said nose rail, respectively.

In this example, a pair of rail members 1 having the same cross section as an ordinary rail are used and joined with each other to be symmetric with respect to the longitudinal center line. The material is a high carbon steel rail material containing 0.70 to 0.82% by weight of carbon. Electron beam welding is used to join said rails and backing material 2, extending in the longitudinal direction, is interposed at the stem point of said pair of rail members 1, 1. The backing material 2, as shown in FIG. 1B, has a narrow width from the front point A to the bending point D—D and a larger width from the bending point to the back. The top and bottom end parts of the backing material 2 extend from the hollow stem part 1*c* of the rail members 1, 1 to the joint of the head part 1*a* and the joint of the base part 1*b* and is contacts to or is held between them. At the point G—G where the rail members 1, 1 branch into two, the backing material 3 is contacts only the joint of the base part 1*b* of the rail member 1 extends in the longitudinal direction. On the other hand, the I-shaped bevel is formed at the joint of the head part 1*a* and base part 1*b* of said rail member 1 and electron beam welding is conducted along the bevel extending on the longitudinal center line.

Said electron beam welding is usually conducted according to the following work flow.

The whole face of the bevel of the rail and the part around it are first degreased and cleaned. A pair of rails and a backing material are then constructed and fixed with a jig, the whole assembly being preheated to 400° C. in a preheating furnace. Immediately after preheating, the resulting rail is carried into the welding chamber of an electron beam welding device with the joint of the base up. Electron beam welding is then conducted where the degree of vacuum within said welding chamber is $5*10^{-4}$ Torr, the temperature of the rail is between 300° to 350° C., and the welding heat input per unit of the plate thickness is between 7–10 KJ/cm$^2$. Air is taken into the welding chamber 10 minutes after the welding is complete, and then the whole is preheated to 400° C. to weld the joint of the head part of the rail. The welding is conducted under the same conditions as those in the case of the base joint. Immediately after that, the whole is heated to 450°–550° C. in an electric furnace as post heating. This completes the between welding process.

Moreover, the head part 1*a* of the joined nose rail is heat processed by slack quenching. In slack quenching ("S.Q.") heat processing, the welded nose rail is put in a preheating furnace and heated to about 500° C. The head part of the V-shaped nose rail is then heated to about 1000° C. and is cooled slowly by injecting compressed air. The tread of the nose rail so heat processed has a homogeneous fine pearlite structure.

Slack quenching ("S.Q.") type heat processing is conducted in the above-mentioned example. However, a high carbon steel material before welding at the head part 1*a* may be preliminarily heat processed by slack quenching so as to have a homogeneous fine pearlite structure. In such a case, even if the electron beam welded nose rail 1 has a small area which is thermally transformed into a pearlite structure around the welded part, that area is very narrow. Almost the whole head part therefore has a fine pearlite structure and forms a tread of the nose rail, so that the rail can be used without further processing.

Figure 2:
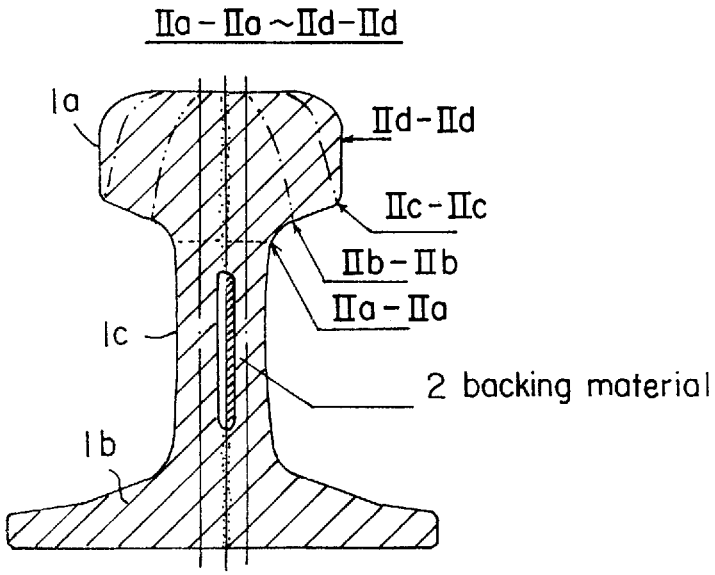
FIG. 2 is a cross-sectional view taken on line IIa—IIa~IId—IId of the nose rail shown in FIG. 1.
Figure 3:
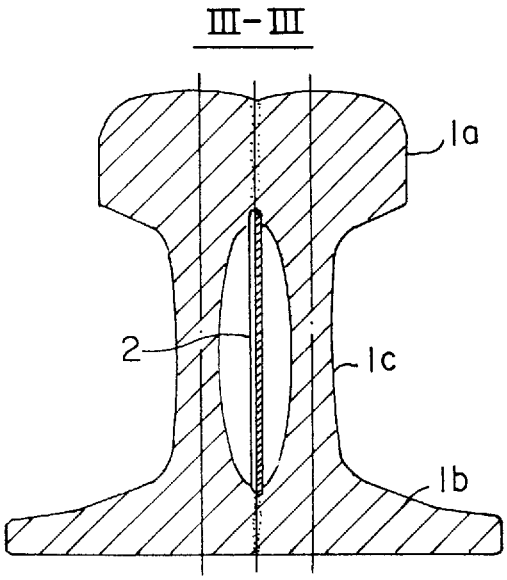
FIG. 3 is a cross-sectional view taken on line III—III of the nose rail shown in FIG. 1.
Figure 4:
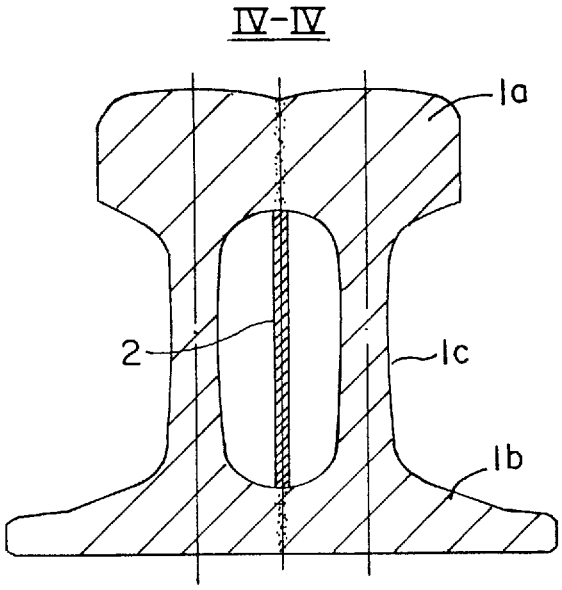
FIG. 4 is a cross-sectional view taken on line IV—IV of the nose rail shown in FIG. 1.
Figure 5:
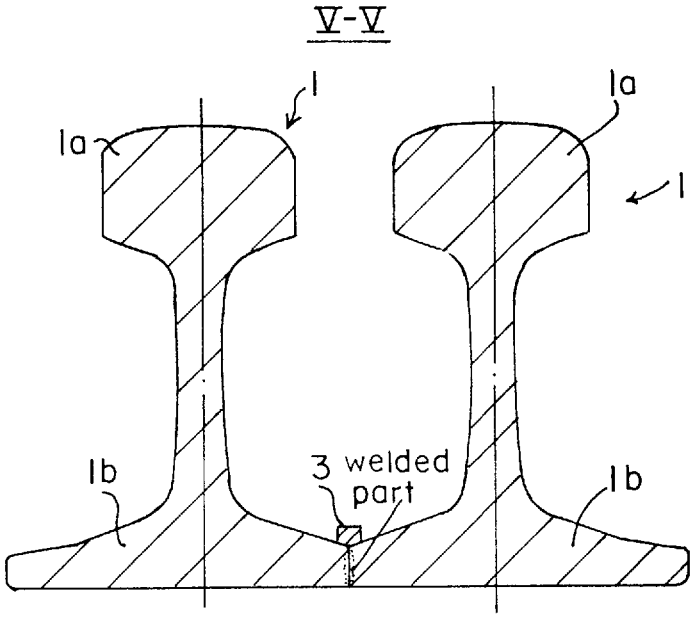
FIG. 5 is a cross-sectional view taken on line V—V of the nose rail shown in FIG. 1.

FIG. 2 to FIG. 5 are transverse cross sectional views of the nose rail produced in this way taken on each point shown in FIG. 1. FIG. 2 is a cross-sectional view taken on line IId—IId at the bending point of the nose rail shown in FIG. 1 and each shape of the cross section taken on IIa—IIa, IIb—IIb, IIc—IIc, respectively, shown in FIG. 1 is illustrated with two-dot chain line. FIG. 3 is a cross-sectional view taken on line III—III of FIG. 1 and FIG. 4 is a cross-sectional view taken on line IV—IV of FIG. 1. A pair of rails 1, 1 which are symmetric have the front parts where the head parts 1*a* as well as the base parts 1*b* are directly joined each other by electron beam welding. Backing material 2 is interposed between the stem parts 1*c*. The backing material 2 has the advantage of absorbing spike and cold shut peculiar to electron beam welding. At a rearward part, past the bending point, as shown in FIG. 3 and FIG. 4, a hollow part appears between the stem parts 1*c*. The width of the hollow part increases in a rearward direction. At the point on line V—V of FIG. 1, as shown in FIG. 5, only the base parts 1*b* are directly joined by electron beam welding using the backing material.

As described above, said backing material 3 can not only absorb spike and cold shut peculiar to electron beam welding, but it also minimizes the necessary thickness of the bevel of the head part or the base part. Therefore, the thickness of the stem part of the front part of the nose rail can be increased, the welding heat input can be decreased, and the temperature of the base material rail need not raised excessively. As a result, the cooling rate of the welded part by heat conduction to the parts around it immediately after welding can be controlled. A high strength nose rail can thereby be obtained.

The welded nose rail 1 is welded with the only wing rail and base part 1*b* which are arranged on the both sides thereof. The nose rail and the wing rail are joined through the filler with bolts and nuts, so that the integrated and fixed crossing is formed. In this case, the nose rail and the wing rail may be joined by only the filler and bolts. The welded crossing like this is welded to have no joint missing line with the ordinary rail at the front and back ends thereof and forms a turnout.

Examples 2 and 3, described below, are nose rails which use a long nose rail and a short nose rail. In view of the relation between the area where the wheel transfers between the wing rail and the nose rail on the basis of the structure of crossing, the welded part of the head part of the nose rail of this type is apart from the point where the impact load acts during the transfer. In addition, the part around said welded part is thermally converted into a very narrow pearlite structure. Therefore, the rail which comprises the high carbon rail material containing 0.70 to 0.82% by weight of carbon as a rail material and is heat processed by slack quenching into having the head part with a homogeneous fine pearlite structure can be used well. Further, just like Example 1, the head part may be heat processed by slack quenching so as to have a homogeneous fine pearlite structure after electron beam welding is complete.

EXAMPLE 2

Figure 6:
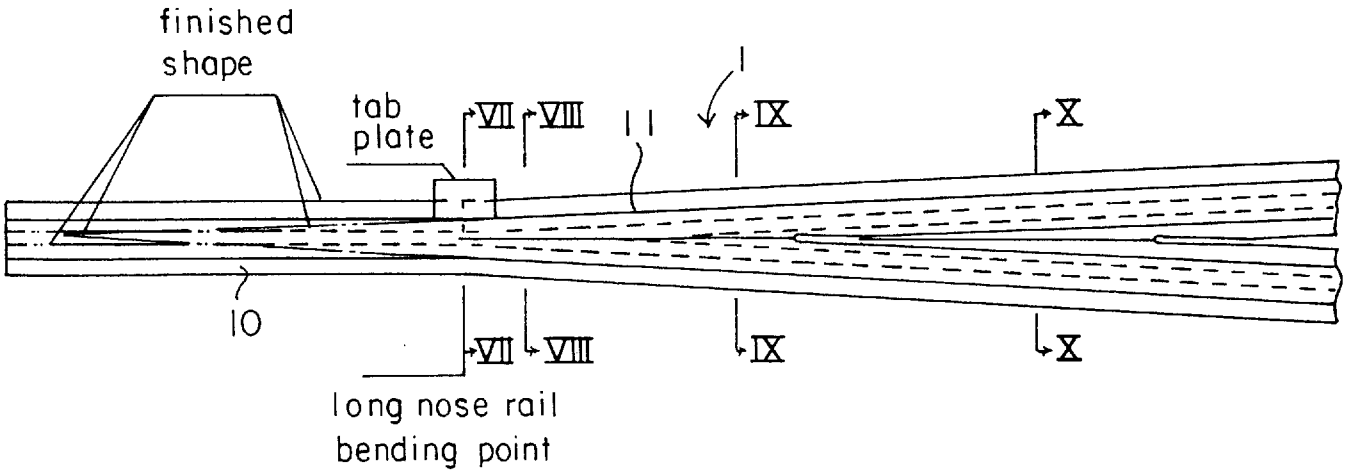
FIG. 6 is a plan view illustrating the whole welded nose rail for crossing of Example 2 produced according to the process of the present invention.

FIG. 6 is a plan view illustrating the whole nose rail for welded crossing of Example 2 and produced according to the method of the present invention. In this example, too, a pair of rails which have the same cross sectional shape as an ordinary rail are used, each of them comprising a long nose rail 10 and a short nose rail 11. The front end of said short nose rail is arranged at the bending point of the head part having a overall width of the long nose rail. The long and short nose rails are symmetric with respect to the center line, so that they can be used as a nose rail for crossing of the compatible type. The rail material is a high carbon steel rail material containing 0.70 to 0.82% by weight of carbon. The long nose rail 10 and the short nose rail 11 are directly joined by welding the head parts and the base parts continuously by curve and linear electron beam welding, and the welded end part is provided with a tab plate.

Figure 7:
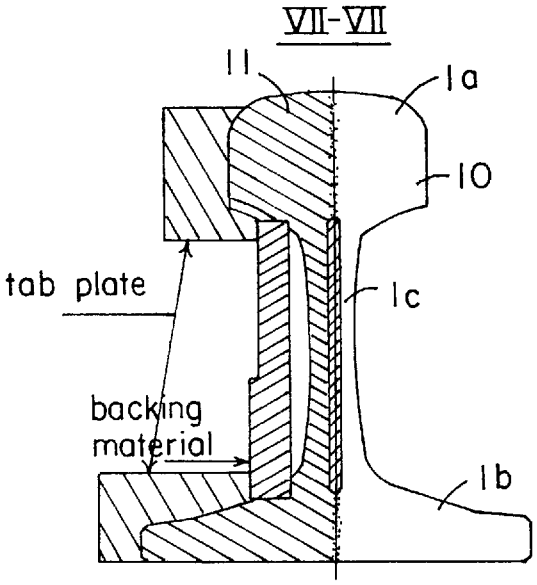
FIG. 7 is a cross-sectional view taken on line VII—VII of the nose rail shown in FIG. 6.
Figure 8:
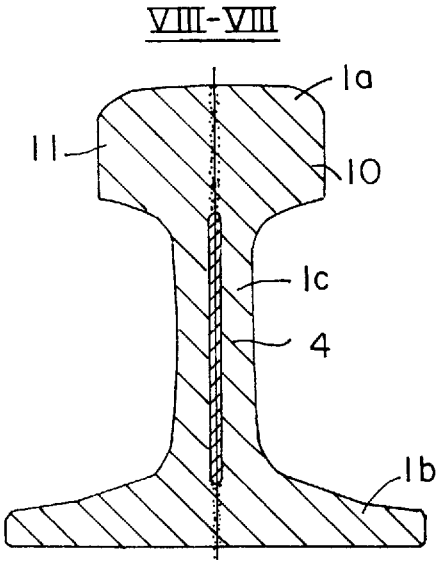
FIG. 8 is a cross-sectional view taken on line VIII—VIII of the nose rail shown in FIG. 6.
Figure 9:
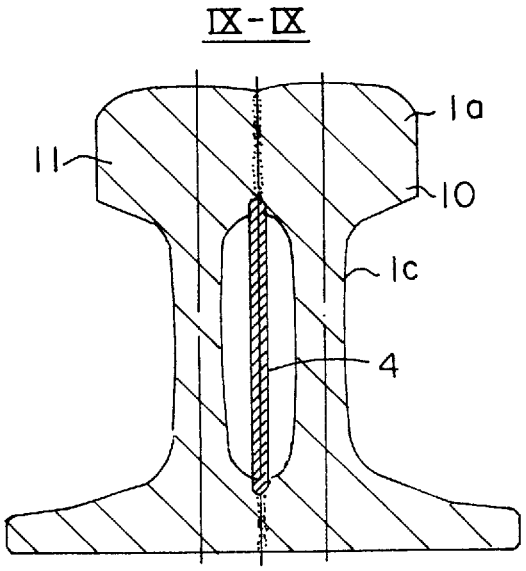
FIG. 9 is a cross-sectional view taken on line IX—IX of the nose rail shown in FIG. 6.
Figure 10:
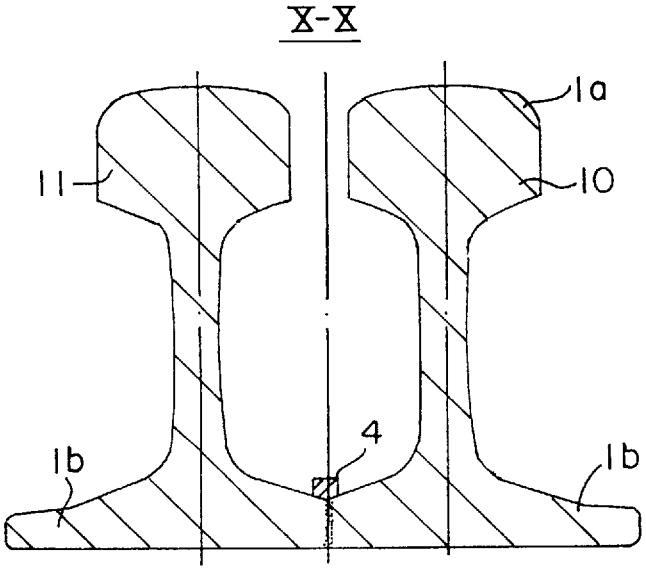
FIG. 10 is a cross-sectional view taken on line X—X of the nose rail shown in FIG. 6.

FIG. 7 is a cross-sectional view taken on line VII—VII of the nose rail 1 shown in FIG. 6, FIG. 8 is a cross-sectional view taken on line VIII—VIII, FIG. 9 is a cross-sectional view taken on line IX—IX, and FIG. 10 is a cross-sectional view taken on line X—X. At the point of the front end part R of the short nose rail, as shown in FIG. 6 and FIG. 7, the backing material 4 extends from the center of the pair of rails, along the R part, to the bottom face of the head chin part and the top face of the base part. Then the tab plate 5 is attached and the head parts 1*a* as well as the base parts 1*b* are directly joined to each other by curve and linear continuous electron beam welding. On the line VIII—VIII, as shown in FIG. 8, the backing material 4 is interposed between both stem parts 1*c*, resulting in a solid structure. Rearward from that point, as shown in FIG. 9 and 10, the hollow part appears between both stem parts 1*c* and the width of the hollow part increases as it goes backward. At the point on line X—X shown in FIG. 6, the only base parts 1*b*, as shown in FIG. 10, are directly joined by electron beam welding using the backing material 4.

Figure 11:
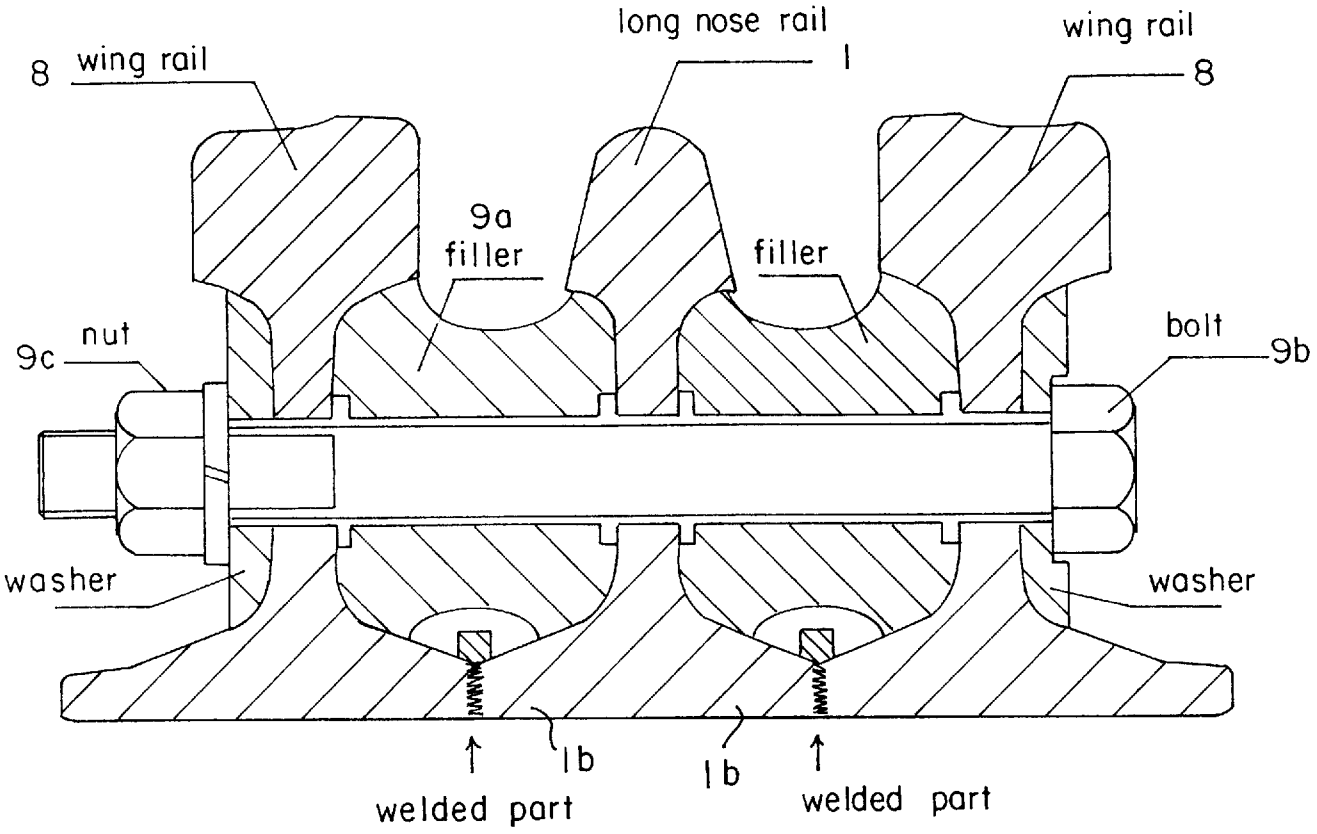
FIG. 11 is a cross-sectional view illustrating the welded crossing using the nose rail shown in FIG. 6.

Like Example 1, the nose rail 1 of Example 2, FIG. 11, is welded with the only wing rail and base part 1*b* which are arranged on the both sides thereof, and the nose rail 1 and the wing rail 8 are joined through the filler 9*a* with bolt 9*b* and nut 9*c*, so that the integrated and fixed crossing is formed. The nose rail 1 and the wing rail 8 may be combined only with the filler 9*a*, bolt 9*b* and nut 9*c*. The welded crossing of this type is welded not to have no joint missing line with the ordinary rail at the front and back ends thereof and forms a turnout.

EXAMPLE 3

Figure 12:
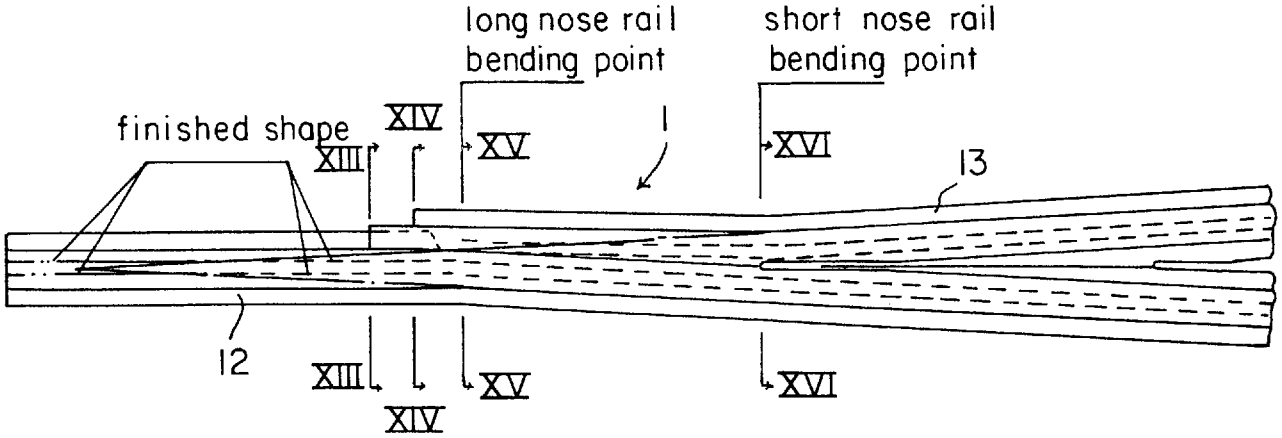
FIG. 12 is a plan view illustrating the whole nose rail for welded crossing of Example 3 produced according to the process of the present invention.

FIG. 12 is a plan view illustrating the whole nose rail 1 for welded crossing of Example 3, produced according to the method of the present invention. In this example, like in Example 2, a pair of rails which have the same cross sectional shape as the ordinary rail are used, each of them comprising a long nose rail 12 and a short nose rail 13. The long nose rail 12 and the short nose rail 13 have their head parts joined directly by linear electron beam welding and their base parts joined by linear and curve electron beam welding. Where the front end of said short nose rail is arranged with respect to the long nose rail, the head part of the short nose rail is beveled from the point XIII—XIII ahead of the bending point XV—XV of the head part having a overall width of head part of the nose rail. The welded end can be eliminated at the point of the cross section XIII—XIII to XIV—XIV by finishing the head part of the nose rail after welding. While in the case of the base part, the welded end can be eliminated by finishing the base part of the nose rail after processing within the base of the short nose rail.

Figure 13:
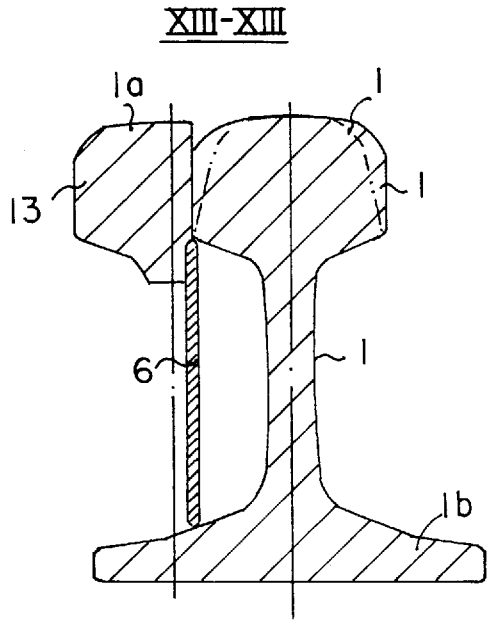
FIG. 13 is a cross-sectional view taken on line XIII—XIII of the nose rail shown in FIG. 12.
Figure 14:
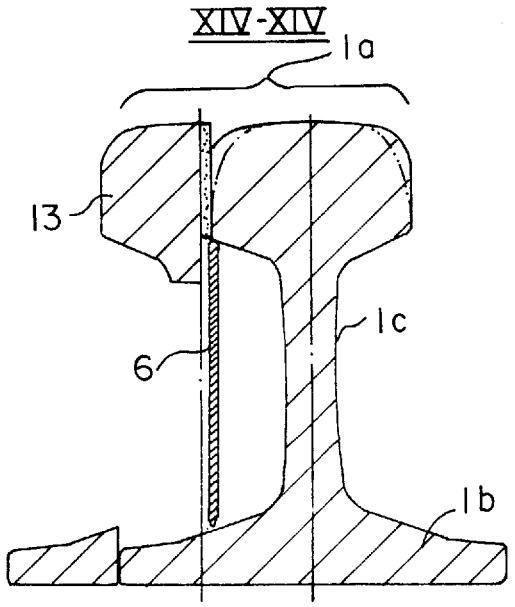
FIG. 14 is a cross-sectional view taken on line XIV—XIV of the nose rail shown in FIG. 12.
Figure 15:
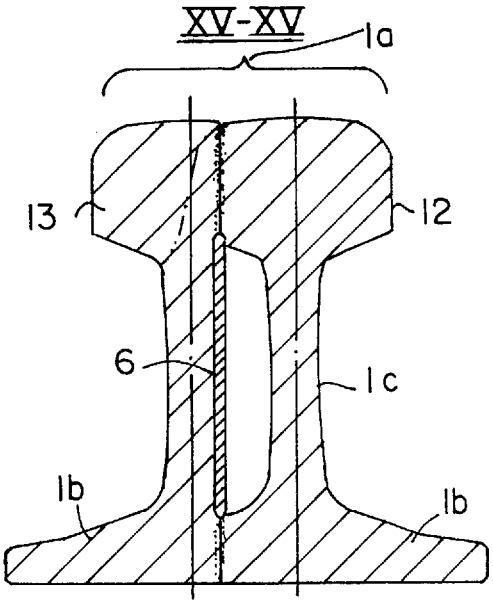
FIG. 15 is a cross-sectional view taken on line XV—XV of the nose rail shown in FIG. 12.
Figure 16:
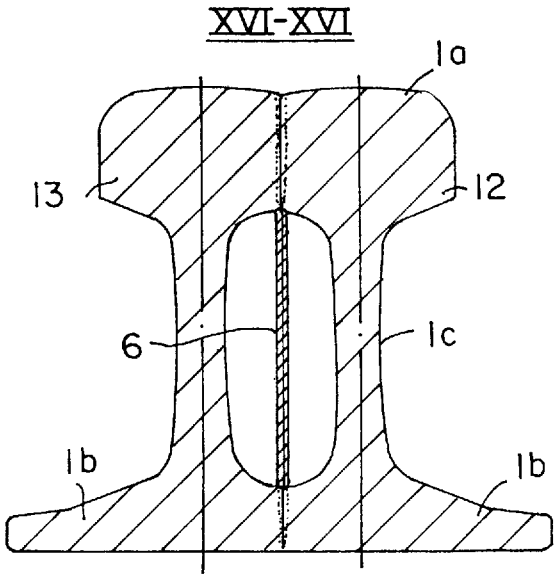
FIG. 16 is a cross-sectional view taken on line XVI—XVI of the nose rail shown in FIG. 12.

FIG. 13 is a cross-sectional view taken on line XIII—XIII of the nose rail 1 shown in FIG. 12, FIG. 14 is a cross-sectional view taken on line XIV—XIV and FIG. 15 is a cross-sectional view taken on line XV—XV. As shown in FIGS. 12, 13 and 14, the stem part and the base part from the front end on line XIII—XIII to the point on line XIV—XIV of the short nose rail 13 is cut and removed with only the head parts 1*a* left. The base part 1*b* from the point on line XIV—XIV to the point on line XV—XV is cut and removed to be R-shaped with the head part 1*a* and the base part 1*b* left. At lines XIII—XIII and XIV—XIV, only the head parts 1*a* are directly joined using the backing material 6 by linear electron beam welding. The depth of the welding decreases gradually between the point on line XIV—XIV and the point on line XIII—XIII and the welding is completed. As shown in FIG. 15, the backing material 6 is interposed between the stem parts 1*c* in the back part, from the bending point of the long rail on line XV—XV and the head parts 1*a* as well as the base parts 1*b* are directly joined by electron beam welding. There is a hollow between the stem parts 1*c*. At the point on line XVI—XVI of FIG. 12 in the back part, as shown in FIG. 16, the long nose rail 12 and the short nose rail 13 have the symmetric cross section and the head parts 1*a* as well as the base parts 1*b* are directly joined using the backing material 6 by electron beam welding.

Like Example 1, the nose rail 1 of Example 3 is welded with the only wing rail and base part 1*b* which are arranged on both sides thereof and the nose rail and the wing rail are combined through the filler with the bolt and the nut, with the result that the integrated and fixed crossing is formed. On the nose rail and the wing rail may be combined only with the filler, bolt and nut. The welded crossing like this is welded to have no joint missing line with the ordinary rail at the front and back ends thereof and forms a turnout.

The heat processing will be more clearly understood with reference to the following description taken in connection with the flow diagram illustrating the continuous S.Q heat processing of the head part of the nose rail for crossing according to an example of the present invention shown in FIG. 17.

Figures 17A, 17B:
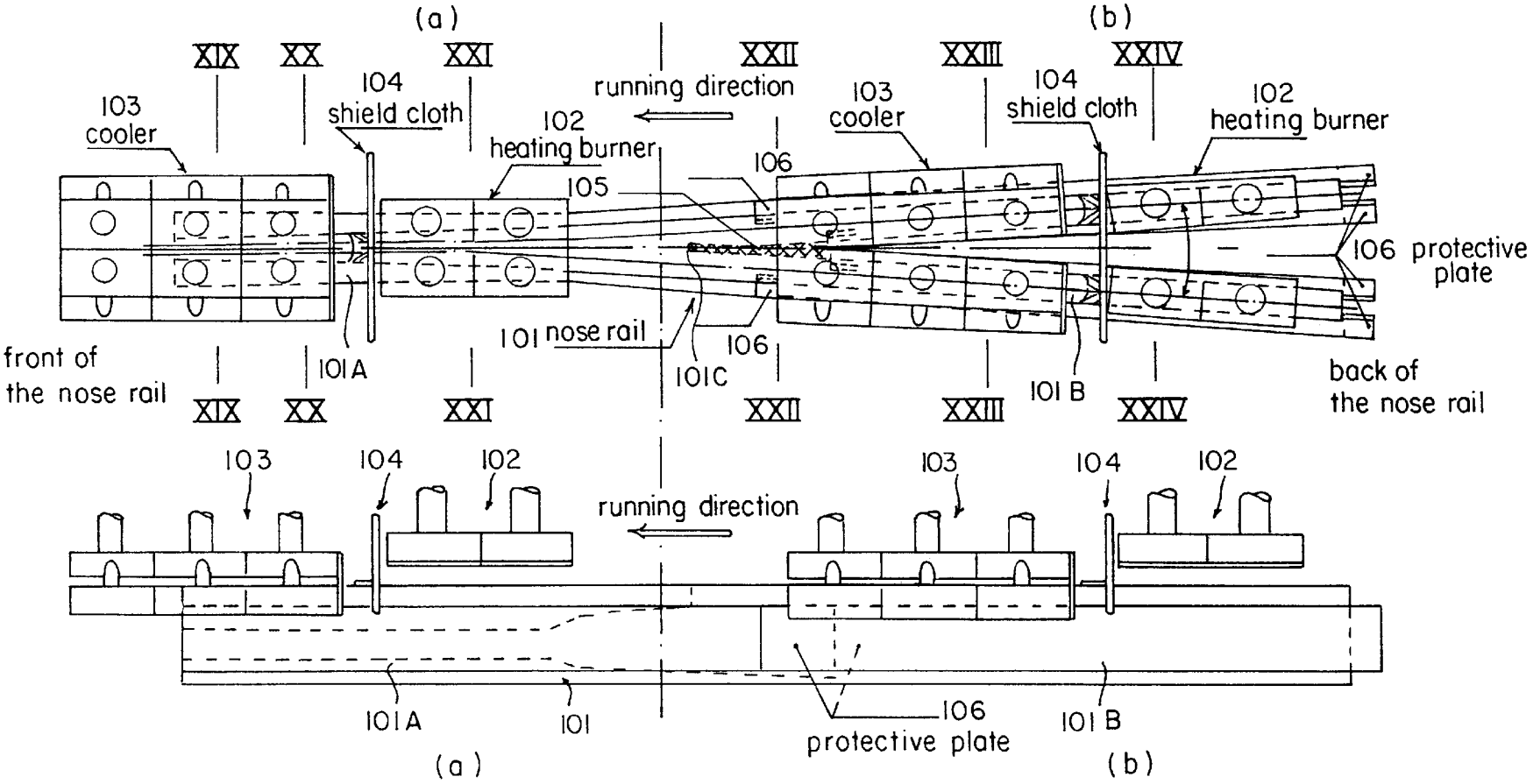
FIGS. 17A and 17B illustrate schematically the whole steps of continuous slack quenching heat type processing of the head part of the nose rail for crossing according to the example of the present invention.

FIGS. 17A and 17B (Section (a)) illustrate S.Q heat processing of the integrated head part 1A of the nose rail 101.

FIGS. 17A and 17B (Section (b)) illustrate S.Q heat processing of the head part 1B branching into two of the nose rail 101.

In the case of the S.Q heat processing according to this example, the S.Q heat processing is conducted continuously from the integrated head 101A of the front part of the rail 101 to the head 101B branching into two of the back part. When the integrated head part 101A is S.Q heat processed, both of the heating burner 102 and the cooler 103 are controlled to be closed. When the head part 101B branching into two is S.Q heat processed, both of the heating burner 102 and the cooler 103 are moved and rotated following the opening width and angle of the head part 101*a* of the rail.

The S.Q heat processing is conducted from the front end of the rail 101 to the back end and the opening between the two the rails increase as it goes backward from the branch part 101C, therefore, the flame of the heating burner 102 streaming backward, with the result that the stream of the flame to the cooler 103 in the front part can be reduced.

And the shield cloth (heat insulating material ribbon) is provided between the heating burner 102 and the cooler 103 to shut out the flame of the burner.

The whole area from the front end of the rail 101 to around the branch part 101C may be preheated to 300° C. to 500° C. with an electric furnace and the like, then the head part 1*a* of the rail may be heated and hardened with the heating burner 102, and the stem part 101*b* as well as the head part 101*a* of the rail may be cooled at the same time by an air shower, in order to obtain the deeper hardened layer. The whole welded part may be preheated, then the head part 101*a* of the rail may be heated and hardened with the heating burner 102, and not only the head part 101*a* but also the stem part 101*b* and the base part 101*c* of the rail may be cooled at the same time only with an air shower, in order to reduce the stress in the welded joint part during heating and cooling. And the distortion occurring after the S.Q heat processing also can be reduced.

In the case that two rails 101 in the rear of the branch 101C of the nose rail are heated and cooled continuously at the same time, in order to prevent each whole rail and two rails from bending due to the break in the balance of heating and cooling, both sides of each rail 101 from the lower surface of the chin 101*d* to the upper surface of the base part 101*c* are covered with a protecting plate and only the head part 101*a* of the rail is heated and cooled, therefore the balance of heating and cooling of each whole rail and two rails being easily maintained, with the result that each rail can be prevented from bending in right and left directions and each of two rails on both sides can bend almost evenly in up-and-down directions.

Figure 18:
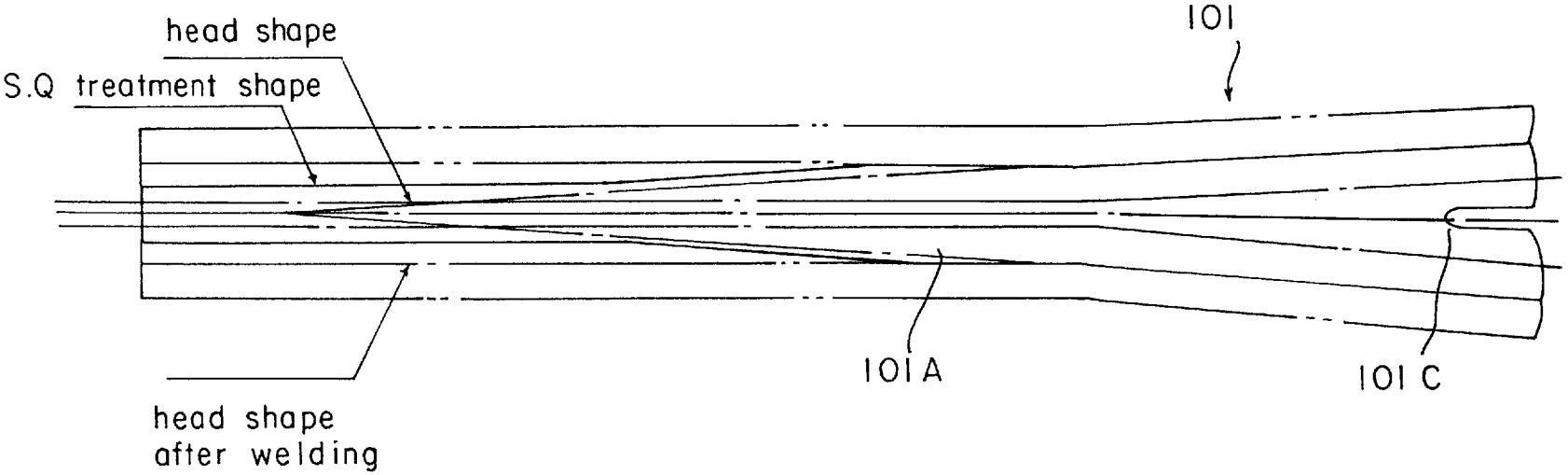
FIG. 18 is a plan view illustrating the front part of said nose rail for crossing.

FIG. 18 illustrates the shape 101A of the front head part of the nose rail 101. After the front part 101A of the nose rail is welded, the head is half-processed into having the maximum width and shape to satisfy surface hardness, cross section hardness and effective hardened layer at the finish of the product, and therefore, S.Q heat processing conditions can be almost even over the whole length of the nose rail.

Namely the processing rate can be kept constant. When heated, the integrated part 101A of the head can be prevented from being overheated by changing the width of the flame in response to the width of the head part. And when cooled, the head part of the rail can be cooled over the length thereof slowly at the required cooling rate by an air shower, which can cool evenly, from the upper surface and the side surface.

Figure 19:
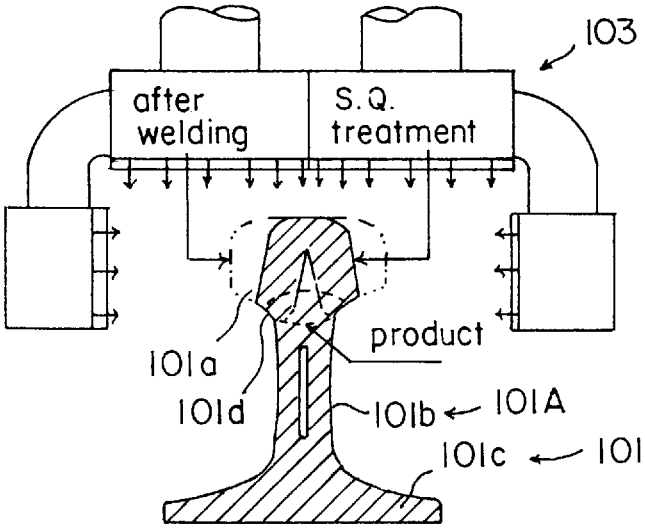
FIG. 19 is a cross-sectional view taken on line XIX—XIX of the nose rail shown in FIG. 17.
Figure 20:
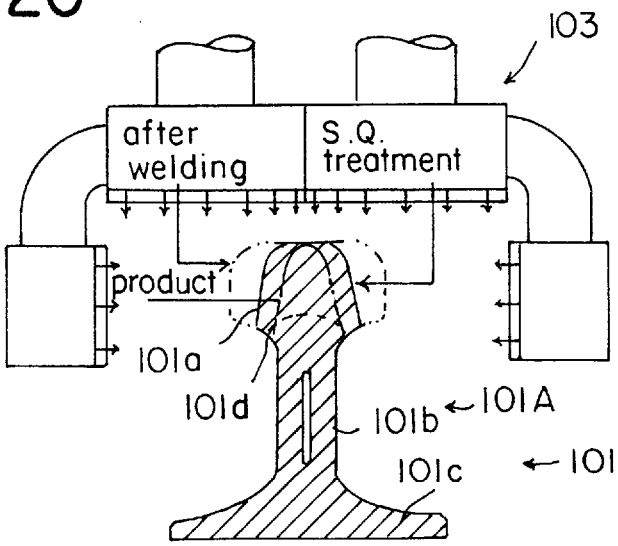
FIG. 20 is a cross-sectional view taken on line XX—XX of the nose rail shown in FIG. 17.
Figure 21:
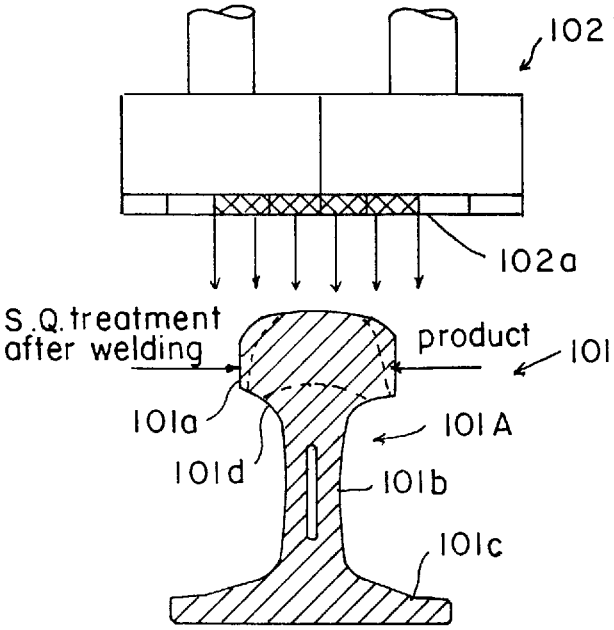
FIG. 21 is a cross-sectional view taken on line XXI—XXI of the nose rail shown in FIG. 17.

FIGS. 19–21 are flow diagrams of S.Q heat processing of the integrated part 101A of the head of the nose rail. FIG. 19 is a cross-sectional view taken on line XIX—XIX of FIG. 17 and illustrates the cooling process at the point where the width of the head part of the nose rail 101 is 0 mm at the finish. The head part 101*a* of the rail is half-processed and the whole nose rail 101 is cooled by injecting the air shower from the cooler 103 to the upper surface and the side surfaces of the head part of the nose rail 101.

FIG. 21 is a cross-sectional view taken on line XXI—XXI of FIG. 17 and illustrates the heating process at the point where the welded nose rail 101 is not half-processed. The width of the flame band of the heating burner 102 is adjusted in response to the width of the head part 101*a* of the rail (see the hatching part 102*a* of the Figure) to prevent overheating.

Figure 22:
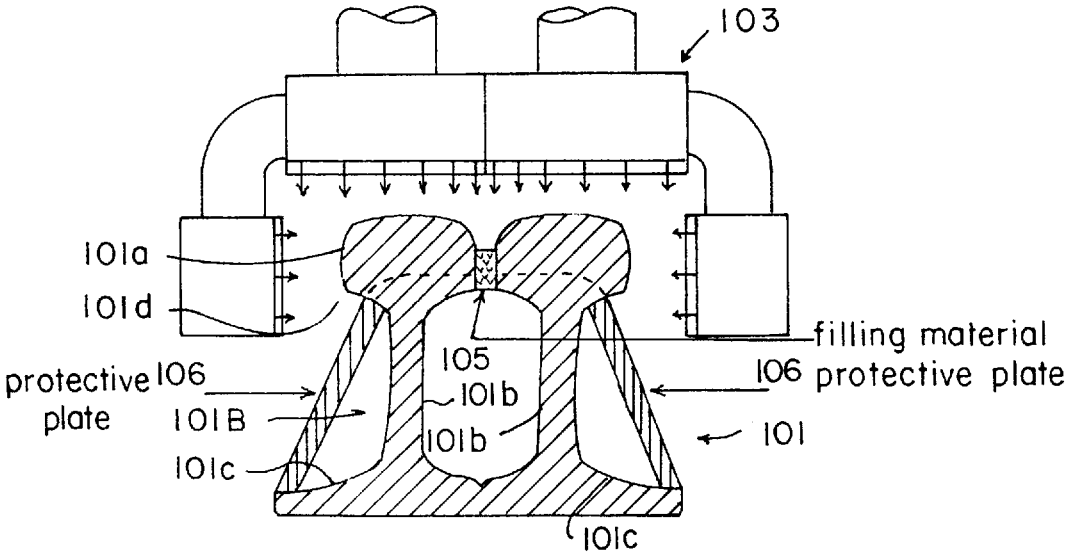
FIG. 22 is a cross-sectional view taken on line XXII—XXII of the nose rail shown in FIG. 17.

FIGS. 22–25 illustrate the S.Q heat processing of the branch part 101B of the head part of the nose rail 101. FIG. 22 is a cross-sectional view taken on line XXI—XXI of FIG. 17 and illustrates the cooling process at the point in the rear of the branch 101C of the nose rail 101. The filling material 105 is provided between the head parts 101*a* of the rail at the branch point 101B, the rail from the chin part 101*a* of the head part on the outside of the rail to the upper face of the base part 101*c* is covered with the protective plate 106, and the air shower from the cooler is injected to the upper and side surfaces of the rail head part, with the result that the only rail head part 101*a* can be cooled.

Figure 23:
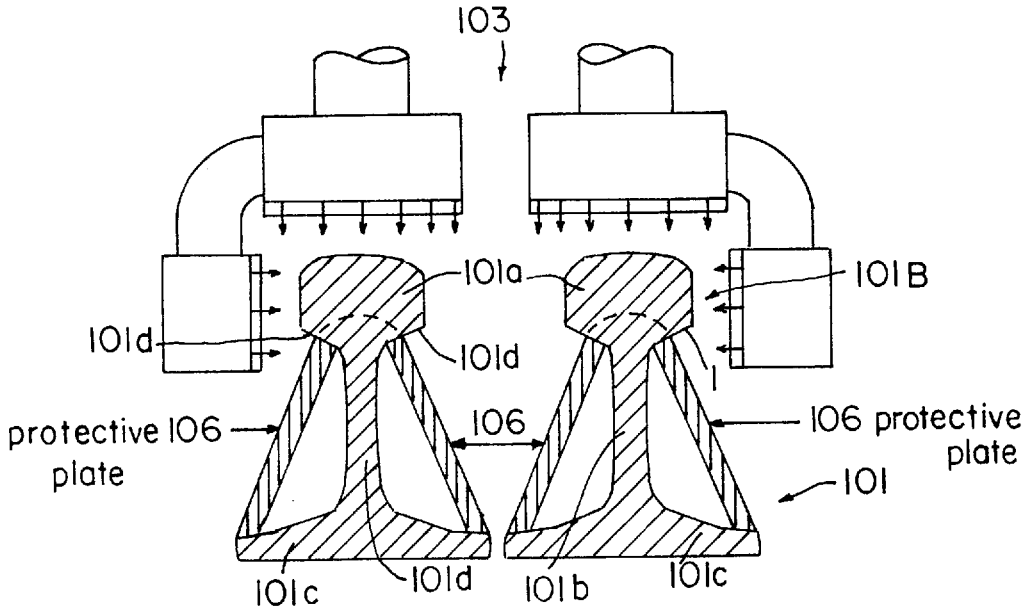
FIG. 23 is a cross-sectional view taken on line XXIII—XXIII of the nose rail shown in FIG. 17.

FIG. 23 is a cross-sectional view taken on line XXIII—XXIII of FIG. 17 and illustrates the cooling process at the point where the nose rail 101 branches into two. The cooler 103 separates at the center and moves to above the head part 101*a* of the rails 101 on the both sides and rotates in response to the opening angle of the rail 101*b* and the air shower of the cooler 103 is injected from the upper surface of the head part 101*a* and the outside surface of the nose rail 101*b*, respectively, with the result that the only rail head 101*a* can be cooled.

Figure 24:
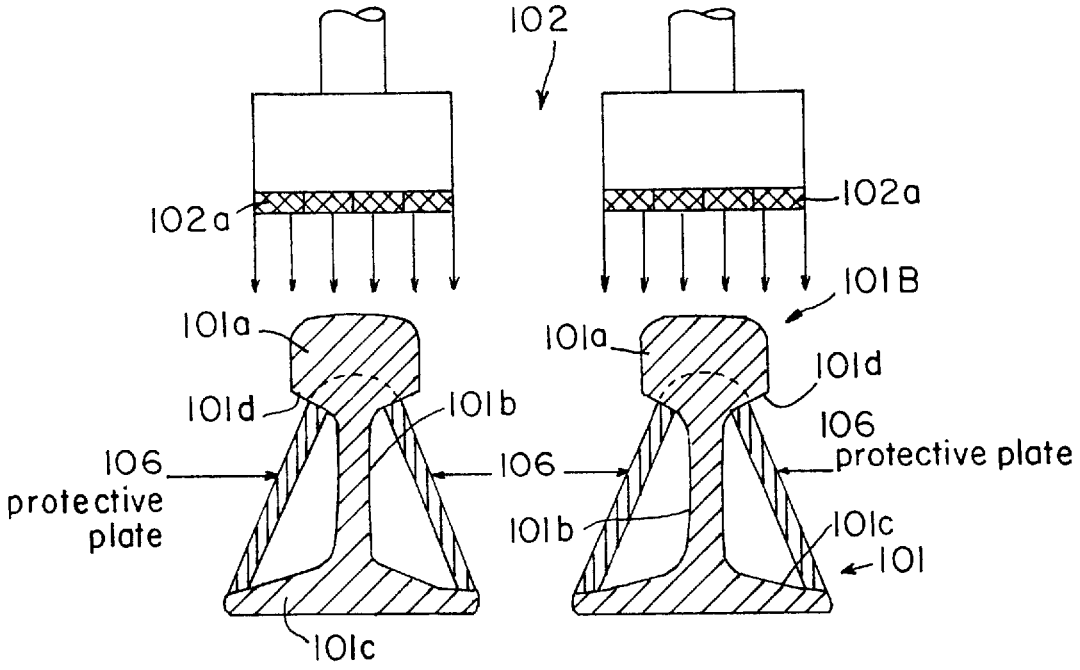
FIG. 24 is a cross-sectional view taken on line XXIV—XXIV of the nose rail shown in FIG. 17.

FIG. 24 is a cross-sectional view taken on line XXIV—XXIV of FIG. 17 and illustrates the heating process at the point where the nose rail 101 branches into two. The heating burner 102 separates at the center and moves to above the head part 101*a* of the rails 101 on the both sides and rotates in response to the opening angle of the rail 101*b* and then, the rail head part 101*a* is heated from each upper surface. And the rail from the chin part 101*d* of the head part on the outside of the rail to the upper face of the base part 101*c* is covered with the protective plate 106, with the result that the only rail head 101*a* can be heated.

FIGS. 25A, B and C are a side elevation view, an elevation view and a bottom view of the heating burner, respectively. The heating burner 102 is a water cooled one. A lateral pair of heating burners 102 are constructed to be able to move horizontally in the direction of the width of the head part 101*a* of the nose rail and rotate in the direction of the opening angle of the head parts and moved and rotated in response to the shape of the rail head part 101*a* by the drive.

The heating burner 102 has a pair of device heads 120 which are laterally symmetric. There are provided plural crater banks 121 in the device head 120 in the direction of the width of the rail head part and the flame band can be controlled by igniting and extinguishing remotely the crater bank. The flame strength of each device head 120 can be controlled by adjusting the gas flow of each device head 120.

There is provided a heating band burner 102 in the first half part in the proceeding direction of the rail and a soaking band burner 102 in the latter half part, resulting in the structure having two blocks. The heating band burner 102, at the beginning of the heating by the burner, raises the temperature around the surface of the rail head part 101*a* and heats rapidly to about 800°–900° C. with the neutral flame to increase the hardening-and-heating depth, while the soaking burner 102 provides uniform temperature dispersion by thermal diffusion after rapid heating, increases the hardening-and-heating depth by heat conduction, and heats to the required hardening temperature with reducing flame to prevent over-heating and decarburization around the surface, with the result that the deeper hardened layer can be obtained efficiently.

Figures 26A, 26B, 26C:
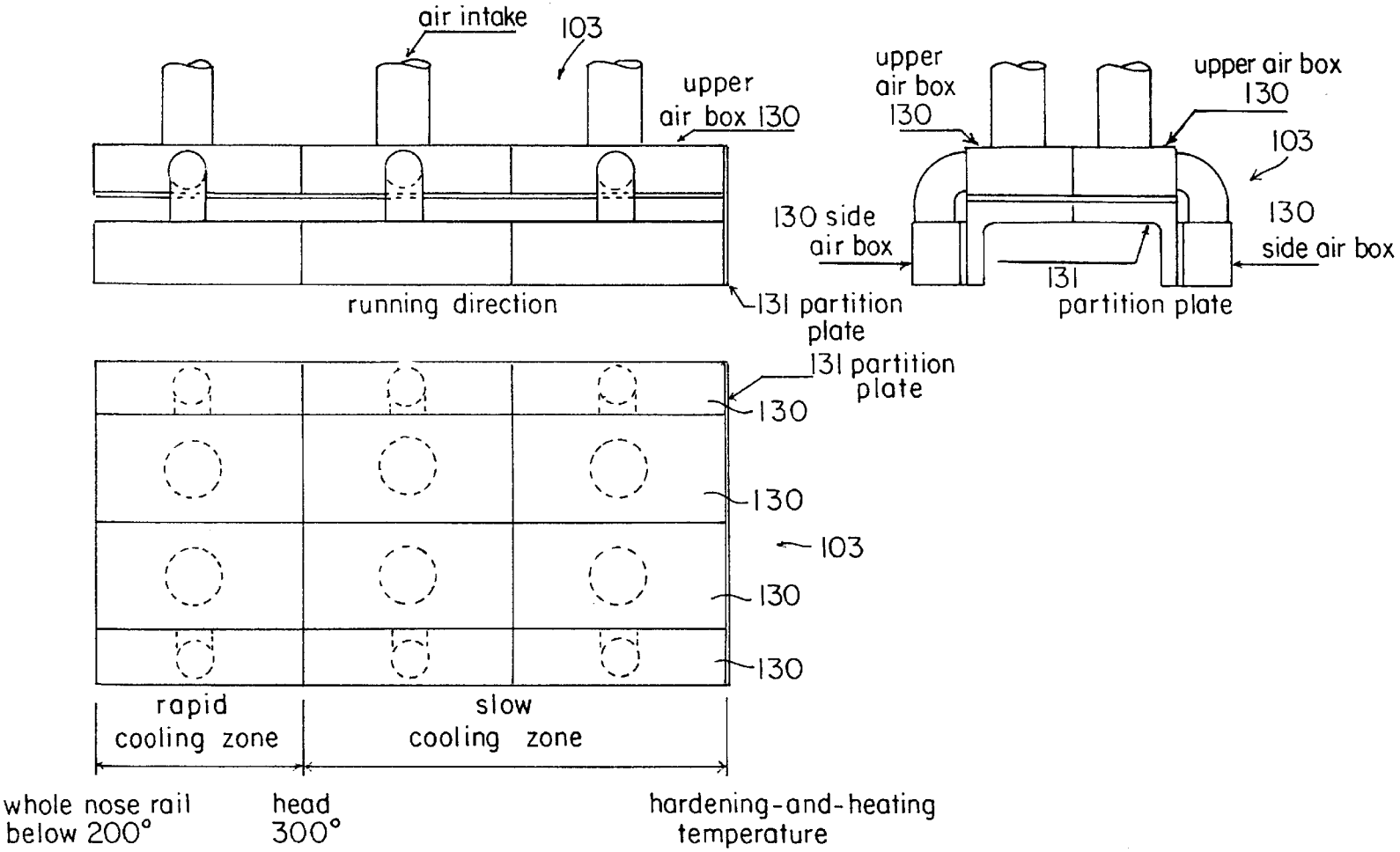
FIGS. 26A–C illustrate in side elevation (FIG. 26A), in vertical elevation (FIG. 26B) and in bottom (FIG. 26C) the cooler used in said continuous slack quenching type heat processing of the head part.

FIGS. 26A, B and C are a side elevation view, an elevation view and a bottom view of the cooler 103. The cooler 103 injects condensed air from an air compressor or a blower as an air shower to the rail head part 101*a* and is, like the heating burner, moved and rotated in response to the shape the rail head part 101*a* by the driver.

The cooler 103 has a pair of air boxes which are laterally symmetric and each air box 130 has a structure comprising an air box which injects an air shower from the upper surface and the outside surface of the rail head part 101*a*, the cooling ability of the air shower by the condensed air of each air box 130 being able to be controlled by adjusting the air flow of each air box 130. There is provided a partition plate 131 at the entrance of the cooler 103 to prevent the air shower injected from the air box 130 from flowing along the surface of the rail head part 101*a* to the heating burner 102, to prevent the part around the surface of the rail head part 101*a* heated and hardened from being cooled below the required cooling rate and to prevent the surface hardness and the cross section hardness around the surface from declining after the S.Q heat processing.

The cooler 103 in the first half cooling part in the proceeding direction of the rail cools the area having a temperature within the range of 800° to 500° C. slowly at the required cooling rate in order that the rail head part 101*a* may have a fine pearlite structure. The temperature around the surface of the rail head part 101*a* becomes 300° C. by passing through said first half slow cooling zone. However, particularly, the interior of the rail head part 101*a* within the range of the tip to the branch 101*b* close to the rail head part 101*a* and the upper part of the stem 101*b* following it have a temperature over 300° C., therefore, further cooling being necessary to prevent softening of the hardened layer, that is, the part having a fine pearlite structure, by the interior heat.

However, in the case that the part of the nose rail 101 having a welded construction is cooled rapidly by water, the large temperature stress occurs at the welded part, therefore, the latter half part of cooling process being a rapid zone cooling by an air shower having a better cooling ability than the first half part, not only to suppress the temperature stress, but also to cool the whole nose rail below 300° C. efficiently. After that, the nose rail is air-cooled to the room temperature.

Effect of Invention

As set forth hereinabove, according to the present invention, the base material of the nose rail is directly joined by electron beam welding without any added hot charge so that the chemical composition of the weld metal is almost the same as that of the base material. Therefore, the welded part has the same pearlite structure as the base material rail or a fine pearlite structure by welding under the conditions of the suitable preheating temperature and welding. Moreover, in the case of electron beam welding, the total heat input is small and the width of the part influenced by heat is very narrow, resulting in little residual stress and distortion after the welding.

And according to the present invention, the whole part from the tip of the nose rail for crossing having an integrated construction to the branch part can be S.Q heat processed by heating and cooling in response to the size and shape of the head part. Therefore, there can be formed a hardened layer having a depth of 20 to 25 mm and a homogeneous pearlite structure, which has a good abrasion and fatigue resistance, over the whole surface of the nose rail for crossing.

What is claimed is:

1. A method for manufacturing a nose rail having an integrated portion and a branched portion, the method comprising the steps of:

providing a pair of rails made from a high carbon steel containing 0.70 to 0.82 wt % of carbon, each rail including a head portion, a base portion, and a concaved middle support portion therebetween, providing a backing plate made from a steel having a carbon content equal to or less than the steel from which the rails are made, abutting a portion of the rails at respective side faces to form a cavity therebetween defined by the respective opposing concaved middle support portions of the rails, wherein the backing plate is at least partially held between the abutting portion of the rails, joining the abutting portion of the rails at least one of the respective pair of head portions and the respective base portions thereby obtaining the nose rail having the integrated portion with the backing plate held therein, and slack quenching the nose rail, whereby a homogeneous fine pearlite structure is obtained in at least a portion thereof.

2. A method for manufacturing a nose rail having an integrated portion and a branched portion, the method comprising the steps of:

providing a pair of rails, each rail including a head portion, a base portion and a concaved middle support portion therebetween and being made from a high carbon steel containing 0.70 to 0.82 wt % of carbon, providing a backing plate made from a steel having a carbon content equal to or less than the steel material from which the rails are made, slack quenching each rail to provide a homogenous and fine pearlite structure in at least a portion of each rail, abutting a portion of the pair of slack quenched rails at respective sides thereof to form a cavity therebetween defined by the respective opposing concaved middle support portions, wherein the backing plate is at least partially held between the abutting portion of the slack quenched rails, and joining the abutting portion of the slack quenched rails at least one of the respective head portions and the respective base portions thereby obtaining the nose rail having the integrated portion with the backing plate held therein.

3. The method according to claim 1, wherein said step of slack quenching is carried out continuously and comprises the steps of:

moving a pair of heating burners relative to the nose rail in a direction from the integrated portion towards the branched portion, and adjusting a spacing of the pair of heating burners such that each heating burner follows a respective one of the rails at the branched portion; and selectively controlling a heating output from each heating burner while moving the heating burners relative to the nose rail.

4. The method according to claim 1, wherein said step of slack quenching further comprises the steps of:

moving a pair of air coolers relative to the nose rail in a direction from the integrated portion towards the branched portion and adjusting a spacing of the pair of air coolers such that each air cooler follows a respective one of the rails at the branched portion; and selectively controlling a cooling air output from the air coolers while moving the air coolers relative to the nose rail.

5. The method according to claim 1, further comprising a step of thermally isolating the head portion of the integrated portion and the head portions of the respective rails at the branched portion, whereby only the head portions are slack quenched.

6. The method according to claim 1, further comprising a step of preheating the nose rail prior to said step of slack quenching.

7. The method according to claim 4, comprising a step of cooling the nose rail to below 300° C. using the pair of air coolers.

8. The method according to claim 1, wherein said step of joining the abutting portions of the rails is performed using electron beam welding.

9. The method according to claim 3, wherein the heating burners provide heat using a flame, said step of selectively controlling a heating output comprising controlling a width of the flame from the heating burners.

10. The method according to claim 5, wherein said step of thermally isolating the head of the integrated head portion and the head portions of the rails at the branched portion of the nose rail comprises providing a protective plate at respective sides of the integrated portion and the rails at the branched portion such that substantially only the head portion of the integrated portion and the head portions of the rails at the branched portion are exposed.

11. The method according to claim 6, wherein said step of preheating the nose rail comprises preheating the nose rail to between 300° C. and 500° C.

12. The method according to claim 2, wherein said step of slack quenching is carried out continuously and comprises the steps of:

moving a pair of heating burners relative to and along respective ones of the pair of rails; and selectively controlling a heating output from each heating burner while moving the heating burners.

13. The method according to claim 2, where in said step of slack quenching further comprises the steps of:

moving a pair of air coolers relative to and along respective ones of the rails; and selectively controlling a cooling air output from the air coolers while moving the air coolers.

14. The method according to claim 2, further comprising a step of thermally isolating the respective head portions of the pair of rails whereby only the head portions are slack quenched.

15. The method according to claim 2, further comprising a step of preheating the pair of rails prior to said step of slack quenching the rails.

16. The method according to claim 13, comprising a step of cooling the pair of rails to below 300° C.

17. The method according to claim 1, wherein said step of joining the abutting portion of the slack quenched rails is performed using electron beam welding.

18. The method according to claim 12, wherein the heating burners provide heat using a flame, said step of selectively controlling a heating output comprising controlling a width of the flame from the heating burners.

19. The method according to claim 15, wherein said step of thermally isolating the respective head portions of the pair of rails comprises providing a protective plate at respective sides of each rail such that substantially only the head portions of each rail are exposed.

20. The method according to claim 15, wherein said step of preheating the pair of rails comprises preheating the pair of rails to between 300° C. and 500° C.

* * * * *